United States Patent [19]

Kouns et al.

[11] 4,381,176

[45] Apr. 26, 1983

[54] DESTROKING START VALVE FOR VARIABLE DISPLACEMENT PUMP

[75] Inventors: Herbert H. Kouns, Camarillo; Richard A. Clark, Oxnard, both of Calif.

[73] Assignee: Abex Corporation, New York, N.Y.

[21] Appl. No.: 292,461

[22] Filed: Aug. 13, 1981

[51] Int. Cl.[3] ..... F04B 1/26

[52] U.S. Cl. ..... 417/222

[58] Field of Search ..... 417/213, 218-222; 60/445, 451, 452

[56] References Cited

U.S. PATENT DOCUMENTS

| | | | |
|---|---|---|---|
| 3,635,021 | 1/1972 | McMillen et al. | 417/222 X |
| 3,753,627 | 8/1973 | Ward | 417/213 |
| 3,865,514 | 2/1975 | Lonnemo | 60/452 X |

*Primary Examiner*—Edward K. Look

*Attorney, Agent, or Firm*—Thomas S. Baker, Jr.; David A. Greenlee

[57] ABSTRACT

A destroking device for use with a variable displacement hydraulic pump driven by an electric motor, which device automatically reduces the displacement of the pump during start-up of the motor to a value which will ensure that the motor will accelerate to its rated speed and automatically relinquishes control of the pump when the motor reaches its rated running speed.

3 Claims, 1 Drawing Figure

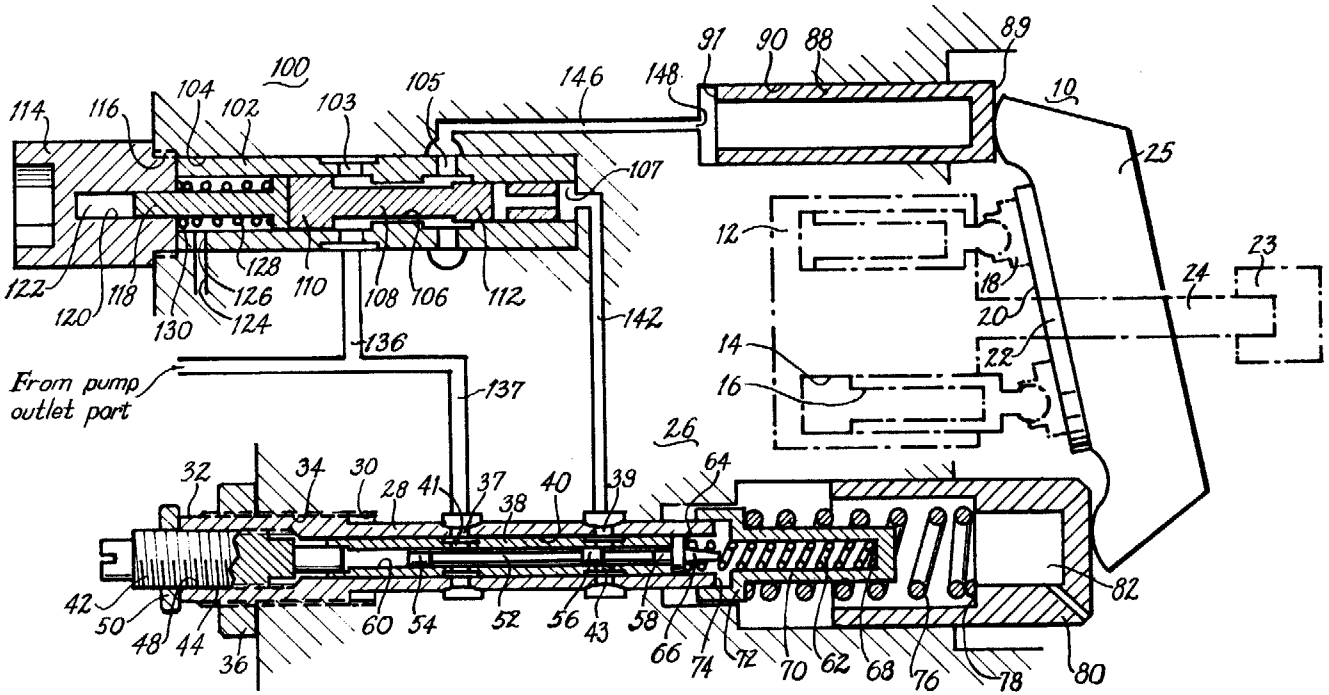
From pump outlet port

DESTROKING START VALVE FOR VARIABLE DISPLACEMENT PUMP

BACKGROUND OF THE INVENTION

The instant invention relates to a valve which limits the output torque of a hydraulic pump driven by an electric motor during start-up of the electric motor to a value which will ensure that the motor can accelerate to its rated speed.

In the instant invention a variable displacement, pressure compensated, hydraulic pump, of the type shown in U.S. Pat. No. 3,250,227 to Kouns and specifically incorporated by reference thereto herein, is driven by an electric motor. The torque output characteristics of some electric motors are such that during start-up the output torque is considerably less than the normal rated running torque of the motor. Some of the causes of low motor torque at start-up are low line voltage, low ambient temperature and high torque demand from the load which the motor is driving. In order to ensure positive acceleration of the electric motor from start-up to its rated speed, the torque required by the driven load, i.e., the hydraulic pump, must be less than the output torque of the electric motor. One method of limiting the required input torque of a variable displacement, hydraulic pump is to reduce the displacement of, i.e., destroke, the pump during start-up of the electric motor. Examples of where variable displacement pumps are destroked on start-up are shown in the following: U.S. Pat. Nos. 2,263,314, 3,834,836 and 4,254,962.

A problem with prior systems which destroke a variable displacement pump during start-up is that they require the use of an auxiliary or external pump. This is undesirable since it increases the cost and weight of the system.

It is desirable to have a device which will destroke a variable displacement pump during start-up of its electric motor which utilizes the output fluid of the variable displacement pump itself to destroke the pump.

It is also desirable to provide a device which will destroke a variable displacement, pressure compensated pump driven by an electric motor and which will automatically relinquish control of the pump to the pressure compensator when the electric motor reaches its rated speed and output torque.

It is further desirable to provide a device which will destroke a variable displacement, hydraulic pump during start-up of its electric motor and will automatically reset itself to assume control of the variable displacement pump each time the electric motor shuts down.

SUMMARY OF THE INVENTION

The instant invention provides a destroking device for use with a variable displacement hydraulic pump driven by an electric motor, which device automatically reduces the displacement of the pump during start-up of the electric motor and automatically relinquishes control of the pump when the electric motor reaches its rated running speed and output torque.

DESCRIPTION OF THE DRAWINGS

The instant drawing shows the destroking start valve of the instant invention incorporated in a pressure compensated, variable displacement, hydraulic pump which is driven by an electric motor.

DESCRIPTION OF THE PREFERRED EMBODIMENT

Referring to the drawing, a variable displacement, pressure compensated pump 10 of the type described in complete detail in the aforementioned Kouns patent is shown schematically. Pump 10 includes a rotatably mounted barrel 12 which has a plurality of circumferentially, equally spaced piston bores 14 formed therein. A piston 16 which has a shoe 18 pivotally mounted thereon projects from one end of each bore 14. Each shoe 18 is held against a flat surface 20 formed on a pivotally mounted thrust plate 22 by a well-known retaining mechanism, not shown. An electric motor 23 drives barrel 12 through a shaft 24. When the barrel 12 is rotated the shoes 18 slide over surface 20. If the thrust plate 22 is inclined from the vertical plane, the pistons 16 reciprocate in their bores 14. The greater the inclination of thrust plate 22 from the vertical plane, the greater the stroke of the pistons 16 and the greater the displacement of the pump 10. When the thrust plate 22 is aligned with the vertical plane, the shoes 18 slide over the surface 20 but do not reciprocate within the bores 14. Thus, the volumetric displacement of the pump varies from zero to maximum depending upon the angle of inclination of the thrust plate 22.

An arm 25 is rigidly attached to thrust plate 22 and projects from one side thereof. Arm 25 is acted upon by a torque control device 26. The function of the torque control device 26 is to provide a constant output torque from the pump 10 which does not exceed the power of the electric motor prime mover 23. The torque control device 26 maintains a maximum displacement setting up to a pressure set by the control device 26. Once the output pressure of the pump 10 reaches the pressure set by the device 26, the displacement of the pump 10 is automatically reduced as the pressure increases to prevent the electric motor 23 from being overloaded.

The destroking start valve of the instant invention works in conjunction with a pressure compensator type torque control device 26 to control the displacement and output pressure settings of the pump 10, as will be described in detail hereinafter. The torque control device 26 will be described first. Torque control device 26 includes an outer ported sleeve 28 which is mounted in a pump housing bore 30. The outer end portion of sleeve 28 includes a head 32 which is threaded into an enlarged threaded bore 34 which is axially aligned with housing bore 30. Outer ported sleeve 28 is locked into its adjustment position by a nut 36 which is screwed onto the threaded portion of head 32 and clamps against the pump housing. A pair of ports 37, 39 are formed in sleeve 28.

An inner compensator sleeve 38 is adjustably mounted within an axial bore 40 formed in outer ported sleeve 28. The sleeve 38 is hydraulically loaded against an adjustment screw 42, one end of which has an external threaded surface 44 which is received in a threaded bore 48 formed in the head 32 of outer ported sleeve 28. Inner compensator sleeve 38 can be adjusted axially with respect to outer ported sleeve 28 by rotating adjustment screw 42. Adjustment screw 42 is locked in position by a nut 50 which is threaded onto threaded surface 44 and tightens against the end of outer ported sleeve head 32. A pair of ports 41, 43 are formed in sleeve 38. Ports 41, 43 are aligned with the ports 37, 39 in outer ported sleeve 28.

A valve spool 52 which includes three lands 54, 56, 58 is mounted in an axial bore 60 formed in inner compensator sleeve 38. Valve spool 52 is normally biased toward the left by a compression-type valve spring 62 which is seated against a shoulder 64 formed on one end of the valve spool 52. Valve spring 62 is held in alignment with valve spool 52 by a tapered member 66 which projects outwardly from shoulder 64. The opposite end of valve spring 62 is seated against the closed end 68 of a hat-shaped sleeve 70. Sleeve 70 includes a flange 72 which engages the end 74 of outer ported sleeve 28 to thereby limit the leftward movement of sleeve 70.

A compression-type arm biasing spring 76 has one end seated against sleeve flange 72 and its other end seated against a shoulder 78 formed on the inside of a cylindrical spring guide 80. The closed end 82 of spring guide 80 is biased against one end of arm 25 by spring 76. Consequently, spring 76 biases thrust plate 22 counterclockwise away from the vertical plane to its position of maximum displacement when the pump 10 is at rest. Also, in this position spool land 56 is positioned to the left of sleeve port 43.

A hydraulic stroke control piston 88 slidable in a housing bore 90 has one end 89 which engages the opposite end of arm 25. Pressure fluid from the outlet port of pump 10 is supplied to the other end 91 of stroke control piston 88 to bias the piston 88 against the end of arm 25 to pivot the arm 25 clockwise in opposition to spring 76. As arm 25 pivots, the thrust plate 22 moves towards the vertical plane to reduce the displacement of the pump 10. Pressure fluid is supplied to stroke control piston 88 to destroke the pump 10 under two conditions. The first condition is when the torque control device 26 senses that the torque demand of the pump 10 exceeds the power of the electric motor 23 and the torque control device 26 destrokes the pump 10 to maintain a constant set horsepower. Operation of the torque control device 26 will be described hereinafter. The second condition is when the electric motor 23 is initially started. Under this condition, the destroking start valve of the instant invention supplies fluid to the stroking piston 88 to prevent the electric motor 23 from being overloaded by the torque demand of the pump 10 until the motor 23 has reached its maximum rated speed and power output. The description of the destroking start valve 100 of the instant invention is as follows.

Destroking start valve 100 includes a sleeve 102 which is mounted in a housing bore 104. Three ports 103, 105, 107 are formed in sleeve 102. Sleeve 102 has a stepped axial bore 106. A spool 108 having a pair of unequally sized lands 110, 112 is slidably received in stepped axial bore 106. Sleeve 102 and spool 108 are retained in bore 104 by a plug 114 which is received in a threaded housing bore 116. Spool 108 engages a cylindrical damping member 118 which projects into an axial bore 120 formed in plug 114 to define a damping chamber 122. The function of damping member 118 and chamber 122 will be described hereinafter. A passage 124 connects a fourth port 126 formed in sleeve 102 between damping chamber 122 and spool land 110 to drain. A spring 128 is interposed between a shoulder 130 formed on the end of plug 114 and land 110 to bias spool 108 to the right in bore 106. In this position spool land 112 is between sleeve ports 105, 107 and port 103 is connected to port 105. Port 103 of destroking start valve 100 is connected to port 37 in outer ported sleeve 28 of torque control device 26 by fluid passages 136, 137, and port 107 in valve 100 is connected to port 39 in sleeve 28 by a passage 142.

Operation of the destroking start valve 100 and the torque control device 26 is as follows. When the pump 10 is at rest, the torque control device 26 is inoperative and arm 25 is biased to the position of maximum pump displacement by spring 76. The torque control device 26 does not act during start-up of the electric motor 23. At this time the destroking start valve 100 functions. When the electric motor 23 is started, the torque control device 26 and destroking start valve 100 are in the positions shown in the drawing. Outlet pressure fluid from the pump outlet port is supplied through passage 137 to port 37 in outer ported sleeve 28 of torque control device 26 and through passages 137, 136 to port 103 in destroking start valve 100. The fluid from port 103 flows through bore 106 between lands 110, 112 and exits from destroking start valve 100 through port 105 into a fluid passage 146 which connects to a port 148 which opens into stroke control piston bore 90. The fluid biases the stroke control piston bore 90. The fluid biases the stroke control piston 88 to the right to move the arm 25 in a clockwise direction to thereby reduce the displacement of the pump 10. In the instant pump 10 an outlet fluid pressure of 200 psi acting on the stroke control piston 88 will move arm 25 to destroke the pump 10.

Referring to the portion of the drawing which illustrates the destroking start valve 100, it can be seen that the pressure fluid in the path between ports 103 and 105 acts on one surface of each of the lands 110, 112. Also, it can be seen that land 110 is larger than land 112. As the pressure of the outlet fluid increases the force generated by the fluid acting on the differential of the areas of the lands 110, 112 and applied to spool 108 increases. This force biases spool 108 to the left and eventually overcomes the force of spring 128. When spool 108 is moved to the left, land 112 moves to the left of sleeve port 105 and interrupts the supply of pressure fluid to stroke control piston 88. At this point the destroking start valve 100 is disabled and spool 108 does not move to the right to unblock port 105 and reset valve 100 until the electric motor 23 is shut down.

In the instant invention it has been found that if the spring 128 has a value of 6 lbs. the spool 108 will shift to the left when the outlet fluid pressure reaches approximately 500 psi. Torque control device 26 starts to operate when the outlet fluid pressure reaches approximately 700 psi. Thus, destroking start valve 100 relinquishes control of pump 10 before the torque control device 26 becomes operative.

The electric motor 23 for pump 10 comes up to its rated speed very quickly, in approximately one-fourth of a second. However, the pressure of the fluid in the outlet port of the pump also rises very quickly. In fact, the pump outlet pressure rises so fast that it is necessary to dampen the leftward movement of spool 108 in order to prevent the spool 108 from moving all the way to the left and disabling the destroking start valve 100 before the electric motor 23 reaches its rated speed. In order to provide some damping to spool 108, bore 120 which receives damping member 118 is enlarged to permit fluid to leak around member 118 into damping chamber 122. Consequently, when spool 108 and member 118 are moved to the left by the outlet fluid pressure acting on the differential of the areas of the lands 110, 112, the leftward movement is dampened by the displacement of hydraulic fluid from the chamber 122.

After the destroking start valve 100 has completed its function and is disabled, the torque control device 26 begins to function. Since outlet pressure fluid can no longer flow through the destroking start valve 100 to act on stroke control piston 88, the pressure of the fluid in passage 137 and port 37 begins to increase. This fluid acts on lands 54, 56 of valve spool 52 in the torque control device 26. A slot is formed in the side of land 54 so that the outlet pressure fluid can flow completely around land 54. This means that all of the outlet fluid pressure acts on spool 52. Rightward movement of valve spool 52 by the force generated by the outlet pressure fluid acting on land 56 is resisted by valve spring 62. However, once the pressure of the outlet fluid exceeds the setting of valve spring 62, which pressure may be on the order of 3000 psi, valve spool 52 moves to the right and land 56 moves to the right of inner compensator sleeve port 43. Since port 43 is aligned with outer ported sleeve port 39, the outlet pressure fluid enters destroking start valve port 107 through fluid passage 142. The fluid in port 107 then passes through port 105 and into passage 146. From passage 146, the fluid enters port 148 and acts on end 91 of the stroke control piston 88 to destroke the pump 10. The fluid does not have to move spool 108 to unblock port 105 since the spool 108 remains in its leftmost position after the spool 108 shifts to disable the destroking start valve 100.

As the outlet fluid pressure increases, the stroke control piston 88 moves further to the right and arm 25 pivots towards the vertical plane. When arm 25 moves initially, the small valve spring 62 compresses more quickly than the large spring 76, since the spring 62 has a smaller spring constant. As the valve spring 62 is compressed, the pressure setting of the pump is increased. The valve spring 62 is compressed until flange 72 on hatshaped sleeve 70 engages end 74 of outer ported sleeve 28. This provides the maximum pressure setting for the pump 10. After the flange 72 engages the sleeve end 74, further pivotal movement of arm 25 results only in reduced displacement of the pump 10 at a constant pressure.

As previously mentioned, when the destroking start valve 100 is operating, the force caused by the outlet pressure fluid acting on the differential of the areas of the lands 110, 112 causes the spool 108 to shift to thereby interrupt the supply of outlet pressure fluid to the stroke control piston 88. It has been suggested that if, after the pump 10 is operating at speed, the pressure of the outlet fluid should fall below 700 psi, the destroking start valve 100 would shift to thereby destroke the pump 10 and reduce the outlet fluid pressure, which is unacceptable in some hydraulic systems. However, it has been found that once the electric motor 23 has reached its operating speed, it is impossible to decrease the pressure of the outlet fluid below 700 psi by destroking the pump 10. It is believed that the relatively high outlet fluid pressure required to destroke the pump 10 is necessary because of the high forces generated on the thrust plate 22 when the pump 10 is at speed by the pistons, the springs and the outlet pressure fluid. Consequently, the destroking start valve 100 of the instant invention can only reset after the motor 23 stops.

Throughout this description it has been stated that the pump is driven by an electric motor. It should be apparent that the destroking start valve of the instant invention can also be used on a pump driven by other types of prime movers, such as a turbine or a diesel engine.

Although a preferred embodiment of the invention has been illustrated and described, it will be apparent to those skilled in the art that various modifications may be made without departing from the spirit and scope of the present invention.

What is claimed is:

1. A control for a variable displacement pump driven by a prime mover comprising a thrust plate, means for pivotally mounting the thrust plate such that it is movable between a position of minimum fluid displacement and a position of maximum fluid displacement, a fluid inlet and a fluid outlet, means for biasing the thrust plate towards the maximum fluid displacement position, a stroke control piston, means for guiding the stroke control piston to engage the thrust plate, first valve means alternatively movable between an open position in which pressure fluid from the fluid outlet is supplied to the stroke control piston to move the thrust plate towards the minimum fluid displacement position and a closed position in which the supply of outlet pressure fluid to the stroke control piston is interrupted, means in the first valve means for setting the maximum allowable pressure of the fluid in the outlet, wherein the first valve means is moved to the open position if the pressure of the fluid in the outlet exceeds the set maximum fluid pressure, second valve means alternatively movable between an open position in which pressure fluid from the fluid outlet is supplied to the stroke control piston to move the thrust plate towards the minimum fluid displacement position, and a closed position in which the supply of outlet pressure fluid to the stroke control piston is interrupted, means in the second valve means for setting a minimum fluid pressure in the fluid outlet to which the second valve means responds and means for moving the second valve means from the open position to the closed position to disable the second valve means when the pressure of the fluid in the fluid outlet reaches the set minimum, wherein the second valve means is in the open position when the prime mover is started to thereby reduce the load on the prime mover and is moved to the closed position after the prime mover has reached its rated operating speed.

2. The control of claim 1, wherein the second valve means includes means for damping the response of the second valve means to delay the movement of the second valve means from the open position to the closed position.

3. The control of claim 1, wherein the pressure set by the means for setting the minimum pressure of fluid in the fluid outlet to which the second valve means responds is less than the set pressure of the means for setting the maximum pressure of fluid in the fluid outlet in the first valve means to ensure that the second valve means is in its closed position before the first valve means can move to its open position.

* * * * *